United States Patent [19]

Tesmann et al.

[11] Patent Number: 4,457,850

[45] Date of Patent: Jul. 3, 1984

[54] FLOTATION AIDS AND PROCESS FOR NON-SULFIDIC MINERALS

[75] Inventors: Holger Tesmann, Düsseldorf; Helmut Kachel, Bremerhaven, both of Fed. Rep. of Germany

[73] Assignee: Henkel Kommanditgesellschaft auf Aktien, Düsseldorf, Fed. Rep. of Germany

[21] Appl. No.: 492,280

[22] Filed: May 6, 1983

[30] Foreign Application Priority Data

Oct. 14, 1982 [DE] Fed. Rep. of Germany ..... 3238060

[51] Int. Cl.[3] ..... B03D 1/00; B03D 1/08; C22B 1/00; C22B 3/00

[52] U.S. Cl. ..... 252/61; 210/704; 210/705; 210/709; 252/60; 252/174.18; 560/179; 560/185; 560/189; 562/588; 562/589

[58] Field of Search ..... 252/60, 61, 174.18; 210/704, 705, 729; 560/179, 185, 189; 562/589, 588

[56] References Cited

U.S. PATENT DOCUMENTS

| | | | |
|---|---|---|---|
| 2,120,217 | 6/1938 | Harris | 252/61 |
| 2,778,499 | 1/1957 | Chambelain et al. | 210/704 X |
| 2,950,818 | 8/1960 | Moeller | 252/61 X |
| 3,252,662 | 5/1966 | Lyons et al. | 210/705 X |
| 4,171,261 | 10/1979 | Dorrepaal et al. | 252/61 X |
| 4,282,385 | 8/1981 | Metz et al. | 562/589 |
| 4,368,116 | 1/1983 | Petrovich | 252/61 X |
| 4,368,117 | 1/1983 | Hintikka | 209/4 X |
| 4,387,034 | 6/1983 | Unger et al. | 210/704 X |

FOREIGN PATENT DOCUMENTS 54-4125865 9/1979 Japan .

*Primary Examiner*—John E. Kittle
*Assistant Examiner*—Mukund J. Shah
*Attorney, Agent, or Firm*—Ernest G. Szoke; Henry E. Millson, Jr.; Mark A. Greenfield

[57] ABSTRACT

Flotation aids and a process for the flotation of non-sulfidic minerals. The flotation aids have the formula

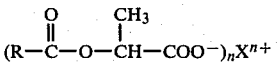

I wherein R repesents an aliphatic, cyclic, or alicyclic $C_7$–$C_{23}$ radical, optionally substituted with one or more hydroxyl, sulfhydryl, carbonyl, ether, or thioether groups; $X^{n+}$ is hydrogen or a water-solubilizing, salt-forming cation; and n is the valence of X. The invention also relates to ore suspensions and mineral concentrates in association with the above flotation aids.

20 Claims, No Drawings

FLOTATION AIDS AND PROCESS FOR NON-SULFIDIC MINERALS

BACKGROUND OF THE INVENTION

There are several known processes for the enrichment of valuable non-sulfidic minerals from ground crude ores by flotation. Valuable minerals of this type are, for example, apatite, fluorite, scheelite and other salt-like minerals, cassiterite and other heavy-metal oxides, for example those of titanium and zirconium, and certain silicates and aluminium silicates which are floated, for example in the presence of so-called collectors. In many cases, the collectors used are fatty acids, particularly unsaturated fatty acids, such as oleic acid. Other suitable collectors are, for example, sulfonate surfactants, such as alkyl aryl sulfonates, sulfosuccinic acid monoalkyl esters or alkyl or aryl phosphonates.

However, collectors such as these based on fatty acids or sulfonates are known to be comparatively non-selective because they are also suitable for the flotation of silicate-containing and carbonate-containing minerals and, for this reason, are of only limited use in cases where accompanying minerals such as these have to be separated off from other valuable minerals. Accordingly, other aids or complicated mixtures of reactants have to be added to depress the undesirable gangues. Consequently, technical problems are presented; in particular, when selective flotation is carried out in the presence of calcite as gangue, the use of fatty acids or collectors containing sulfo groups results in significant practical disadvantages.

DESCRIPTION OF THE INVENTION

The present invention relates to the use of at least one acyl lactylate having the following formula:

$$(R-\underset{\underset{O}{\|}}{C}-O-\underset{\underset{CH_3}{|}}{CH}-COO^-)_nX^{n+} \qquad (I)$$

as a collector in the flotation of non-sulfidic minerals. In formula I, R represents an aliphatic, cyclic, or alicyclic $C_7$–$C_{23}$ radical. R can be a saturated or unsaturated linear or branched chain aliphatic or cycloaliphatic group, or an aromatic or alkyl substituted aromatic hydrocarbon group, or an aralkyl group, wherein said groups are optionally substituted with one or more hydroxyl, sulfhydryl, carbonyl, ether, or thioether groups. The unsaturated aliphatic or cycloaliphatic group can be mono- or polyolefinically unsaturated. Aromatic and alkyl substituted aromatic hydrocarbon groups include phenyl or alkylsubstituted phenyl such as tolyl, xylyl, etc., naphthyl or alkyl substituted naphthyl, or other fused ring unsubstituted or alkyl substituted aromatic hydrocarbons having a total of from 7 to 23 carbon atoms. Examples of aralkyl groups include benzyl, o-methylbenzyl, α-methylbenzyl, naphthylmethyl, etc. R is preferably a straight chain alkyl or a mono- or diolefinic alkenyl group, optionally substituted with one or more hydroxyl groups. In the above formula $X^{n+}$ represents a hydrogen ion or a water-solubilizing saltforming cation and n represents the valence of the cation.

The production of acyl lactylates corresponding to formula (I) is known, cf. Chemical Abstracts 55, 14740i (1961); 60, 13803e (1964); 65, 619c (1966) and 80, 107951q (1974). In these known processes, carboxylic acids or their functional derivatives, such as acyl halides, are reacted at elevated temperature with lactic acid or with salts of lactic acid, for example sodium lactate. Removal of the water of reaction formed or other volatile reaction products, such as hydrogen halides, may be accelerated by carrying out the reaction under reduced pressure, by introducing inert gases, or by using azeotrope-forming solvents. The presence of suitable esterification catalysts can also be of advantage. Other suitable processes are those in which acyl esters derived from lower alcohols, such as methanol, and lactic acid esters are transesterified in the presence of transesterification catalysts with removal of the lower alcohol. Oligomeric lactyl lactylates and esters of oligomeric lactyl lactylates are formed in addition to the acyl lactylates, depending on the composition of the starting mixture and the reaction conditions.

The reaction mixture may also contain small quantities of unreacted starting materials. These impurities do not cause any problems where the products are used in accordance with the invention as flotation aids and, for this reason, may remain in the product.

Carboxylic acids suitable for esterification with the lactic acid are aliphatic, cycloaliphatic, aromatic and alkyl aromatic carboxylic acids containing from 8 to 24 carbon atoms. The carboxylic acids may contain linear or branched radicals and may also be substituted, for example by one or more hydroxyl, sulfhydryl, carbonyl, ether or thioether groups. They are preferably derived from aliphatic, straight-chain, saturated or unsaturated carboxylic acids. Examples of carboxylic acids such as these are caprylic acid, capric acid, lauric acid, myristic acid, palmitic acid, stearic acid, arachic acid, undecenoic acid, lauroleic acid, palmitoleic acid, oleic acid, elaidic acid, ricinoleic acid, linoleic acid, arachidonic acid, erucic acid, brassidic acid and clupanodonic acid. Mixtures of fatty acids such as those of the type obtainable from naturally occurring fats of native or synthetic origin are normally used. Examples of native fatty acid mixtures are those obtainable from tall oil, soy oil, cottonseed oil, palm oil, coconut oil, sunflower oil, rapeseed oil, fish oil, tallow or castor oil.

Lactylates of unsaturated fatty acids and of mixtures of saturated and unsaturated fatty acids of which at least 25% by weight and preferably more than 50% by weight consist of mono- and/or diolefinically-unsaturated fatty acids, particularly oleic acid, have proved to be particularly suitable. Mixtures rich in oleic acid such as these may be obtained in the required purity from native fatty acid mixtures, for example from tallow fatty acids, using known industrial separation processes.

Depending on the pH-value adjusted during flotation, the acyl lactylates will be present as free acids or in the form of water-soluble salts. Suitable salts are salts of sodium, potassium, lithium and magnesium and also salts of ammonium and organic ammonium bases, for example salts of mono- di- or triethanolamine, morpholine or guanidine. The sodium salts are preferred.

The preferred lactylates, which are derived from fatty acid mixtures rich in oleic acid, are viscous liquids having very low setting points, i.e. below −10° to −20° C. This may be regarded as an additional advantage over known fatty acid collectors based on technical oleic acids, which are thickly liquid to paste-like products, because—in contrast to paste-like products—they may be metered very much more quickly and accurately and homogeneously distributed in the mineral pulp, even at low temperatures. Even in the presence of alkaline-earth metal ions, i.e. even where hard water is used, they form an intensive, persistent froth so that, for many applications, there is no need for other foaming agents or additional collectors to be added.

The quantities of acyl lactylates to be used for flotation vary from about 100 to about 3000 g/t (grams per ton of ore), preferably from about 100 to about 2000 g/t, and more preferably from about 100 to about 1000 g/t, according to the type of ore to be floated and the required degree of separation. These quantities can also be exceeded, although selectivity can diminish with overdosage. The optimum quantity for use with a particular ore can be readily determined by routine experimentation.

In addition to the acyl lactylates, other standard collectors, foaming agents and other flotation aids can be used during flotation, enabling the results to be improved even further in certain cases. These other flotation aids include known anionic surfactants, such as fatty acids and other carboxylic acid derivatives, sulfonation products of fatty oils or fatty acids, mineral oil sulfonates, alkyl benzene sulfonates, alkane sulfonates, sulfosuccinic acid esters and semiesters, sulfosuccinic acid amides and semiamides, alkyl sulfates, alkyl ether sulfates, alkyl and dialkyl phosphates, alkyl and dialkyl ether phosphates and alkyl phenol ether sulfates. Known nonionic regulators, such as long-chain alcohols, alkyl phenols and their ethoxylation products can also be present. In order to obtain the high selectivity of the acyl lactylates, the acyl lactylates should be present in a quantity of preferably at least about 25% by weight and, more particularly, at least about 40% by weight, based on the total quantity of collectors and foaming agents present.

Depending on the nature of the dressing problems and the plant available, pH regulators can also be present, as well as inorganic or organic depressors, such as waterglass, starch and starch derivatives, lignin-based reagents, such as lignin sulfonates, dextrins, tannic acid and tannic acid extracts, cellulose derivatives, such as carboxymethyl cellulose, hydroxyethyl cellulose or methyl cellulose, or other known protective colloids. The quantities in which these additives are used can vary within the limits in which they are normally used in the flotation field.

The present invention also relates to a process for separating non-sulfidic minerals from an ore by flotation, ground ores being mixed with water to form an ore suspension, characterized in that air is introduced into the suspension in the presence of a compound of formula (I) in a quantity sufficient for it to act as collector and the desired minerals are separated off from the resulting froth.

The following Examples are intended to demonstrate the superiority of the fatty acid lactylates used in accordance with the invention when compared to known collectors. The tests on which the Examples are based were carried out under laboratory conditions with, in some cases, high collector concentrations which of course may be considerably reduced in practice. Accordingly, the potential applications and application conditions are by no means confined to the separation problems and test conditions given in the Examples.

EXAMPLE 1

The acyl lactylates used in this example were prepared from the following fatty acids:

Type I: distilled oleic acid obtained from tallow fatty acids by phase separation (content of saturated $C_{14}$–$C_{18}$ fatty acids approximately 15% by weight).

Type II: distilled tall oil fatty acid substantially free from resinic acids (resin content below 5%).

Mixtures of the fatty acids with lactic acid in a molar ratio of 1:1 were heated to temperatures of from 150° to 160° C. over a period of 5 hours during which pure nitrogen was introduced. The lactylates obtained had the following physical properties and analytical data (AN=acid number, SN=saponification number, IN=iodine number):

| Type | Setting Point | AN | SN | IN |
|---|---|---|---|---|
| I | −20° C. | 137 | 392 | 63 |
| II | −32° C. | 131 | 377 | 107 |

The arrangement used for the flotation tests consisted of a modified "Hallimond" tube (cf. the Article by B. Dobias in Colloid and Polymer Sci. 259, 775–776 (1981), which had a volume of 160 ml. The apparatus was filled with 1.5 g of a ground phosphorite ore and a solution of the collector (Type II) in a concentration of 28 mg/l corresponding to 3000 g/t. A concentrate was discharged while stirring and while a stream of nitrogen was passed through (9.8 ml/min), being analyzed as a function of time.

In a second test series, the quantity of collector used was reduced to 21 mg/l (2000 g/t).

Mineral used: phosphorite from a sedimentary deposit of high calcite content in which the following constituents were quantitatively determined:

| | |
|---|---|
| $P_2O_5$ | 23.1% |
| CaO | 53.0% |
| $CO_2$ | 16.3% |
| $F^-$ | 2.5% |
| $SiO_2$ | 1.9% |

After the removal of sludge, the particle size distribution was as follows:

| | |
|---|---|
| up to 25 μm | 16.9% |
| 25 to 80 μm | 29.7% |
| 80 to 140 μm | 35.2% |
| over 140 μm | 18.2% |

The pH-value of the flotation solution amounted to 9.5, the lactylate being present in the form of the sodium salt. The results are set out in Table I.

The 1st column shows the quantity of collector in g/t, the 2nd column the flotation time in minutes, column 3 the yield in % by weight, based on the initial quantity of $P_2O_5$, and column 4 the $P_2O_5$ content of the concentrate obtained.

Even after a short flotation time, a high percentage of the phosphate ore is extracted, the phosphate content of the ore sample decreasing with increasing test duration, so that towards the end of the test the phosphate content of the extracted ore also diminishes. Any reduction in the collector concentration increases selectively in favor of a higher phosphate content in the floated concentrate (2nd test series).

TABLE I

| K (g/t) | t (mins) | m (% $P_2O_5$) | c (% $P_2O_5$) |
|---|---|---|---|
| 3000 | 2 | 77 | 25.4 |
| | 5 | 88 | 20 |
| | 12 | 94 | 18 |
| 2000 | 2 | 68 | 25 |
| | 5 | 83 | 22.5 |
| | 12 | 88 | 21.3 |

Table II below shows the results of comparison tests. Sodium oleate was used in test $V_1$, sodium dodecyl benzene sulfonate in test $V_2$ and a sodium sulfosuccinic acid monoalkyl ester ($C_{12}$–$C_{18}$ alkyl radical) in test $V_3$, in each case in a concentration of 3000 g/t of ore. The collectors in tests $V_1$ and $V_2$ are considerably less productive than the compounds used in accordance with the invention. In comparison test $V_3$, the yield is distinctly lower and the necessary flotation time considerably longer than in the test according to the invention for substantially the same $P_2O_5$-content in the concentrate, i.e. a yield m of 65% for a concentrate content c of 25% is only obtained after about 12 minutes whereas in the test according to the invention the same yield is obtained after only 2 minutes. After a flotation time of 12 minutes, the phosphate content in the crude ore used has not undergone any significant reduction in comparison test $V_3$, so that the content c in the concentrate is still relatively high at this stage. This should be taken into account when comparing the test results.

TABLE II

| Test | t (mins) | m (% $P_2O_5$) | c (% $P_2O_5$) |
|---|---|---|---|
| $V_1$ | 2 | 4 | 18.3 |
| | 5 | 20 | 19.7 |
| | 12 | 43 | 22 |
| $V_2$ | 2 | 2 | 15.3 |
| | 5 | 6 | 15.2 |
| | 12 | 13 | 16.8 |
| $V_3$ | 2 | 30 | 22 |
| | 5 | 43 | 24 |
| | 12 | 65 | 25 |

EXAMPLE 2

An apatite ore was floated at 20° C. in a 1-liter capacity flotation cell (model D-1 of the Denver Equipment Co.). The crude ore contained carbonates, olivine and magnetite as gangue. After magnetic separation of most of the magnetite, the following contents were determined:

16.0% of $P_2O_5$
6.2% of $CO_2$
10.4% of $SiO_2$
11.6% of MgO

The grain-size distribution (in % by weight) was as follows:

| | |
|---|---|
| up to 25 μm | 21% |
| 25 to 100 μm | 23% |
| 100 to 160 μm | 14% |
| over 160 μm | 24% |

Flotation was carried out in a single stage with a pulp density of 200 g/l and at a rotational speed of the mixer of 1200 r.p.m. and at a pH-value of 11 in the presence of waterglass in a quantity of 2000 g/t. Fatty acid lactylate (Na-salt, type II) was used as collector in a quantity of 300 g/t. The flotation time was 4 minutes.

In comparison test $V_4$, sodium oleate was used in the same quantity. The results set out in Table III show the greater selectivity of the lactylate compared with the oleate.

TABLE III

| Example | Total yield % | c (%) in the concentrate $P_2O_5$ | $CO_2$ | $SiO_2$ | MgO | m (% $P_2O_5$) |
|---|---|---|---|---|---|---|
| 2 | 26 | 36.0 | 4.4 | 1.7 | 2.4 | 58.5 |
| $V_4$ | 15.6 | 23.1 | 13.6 | 6.5 | 7.7 | 22.5 |

EXAMPLE 3

A fluorite ore intergrown with baryta, quartz and silicates as gangue was floated in the flotation apparatus used in EXAMPLE 2. The following contents were determined by analysis:

23.6% of $F^-$
13.0% of BaO
20.5% of $SiO_2$

Grain size distribution:

| | |
|---|---|
| up to 25 μm | 45% |
| 25 to 100 μm | 30% |
| over 100 μm | 25% |

Flotation was carried out for 4 minutes with a pulp density of 350 g/l and at a rotational speed of the mixer of 1200 r.p.m. 500 g/t of waterglass, 200 g/t of dextrin and 750 g/t of lignin sulfonate were added as depressors. The collectors used were oleic acid lactylate (Na-salt, type I) and, for comparison, sodium oleate ($V_5$) and sodium alkyl ether phosphate ($V_6$). The quantity S of collector used in g/t, the pH-value of the solution and the test results (m based on % by weight of fluorine) are shown in Table IV.

TABLE IV

| Example | S (g/t) | pH | Total yield (%) | c (%) in the concentrate F | BaO | $SiO_2$ | m(F) (%) |
|---|---|---|---|---|---|---|---|
| 3a | 210 | 8.2 | 59.9 | 37.6 | 8.3 | 2.4 | 95.4 |
| 3b | 150 | 8.0 | 59.9 | 39.0 | 11.4 | 2.0 | 98.5 |
| $V_5$ | 210 | 8.3 | 21.8 | 34.6 | 12.7 | 3.3 | 32.0 |
| $V_6$ | 210 | 8.2 | 31.8 | 39.1 | 6.4 | 3.8 | 52.7 |

Once again, the output m is considerably higher by comparison with the known agents.

EXAMPLE 4

Following the procedure of Example 2, a low-value cassiterite ore essentially containing granite, tourmaline and magnetite as gangue was floated for 4 minutes with a pulp density of 300 g/l. The following contents were determined by analysis.

1.1% of $SnO_2$
6.2% of $SiO_2$
6.8% of $Fe_2O_3$

Grain size distribution:

| | |
|---|---|
| up to 25 μm | 60% |
| 25 to 100 μm | 40% |

Waterglass was added as depressor in a quantity of 2200 g/t, after which the pH-value of the pulp was adjusted to pH 5 with sulfuric acid. The collectors used were oleic acid lactylate (Na-salt, type I) and, for comparison, oleic acid ($V_7$), styryl phosphonic acid ($V_8$) and the Na-salt of a sulfosuccinic acid monoalkyl amide ($V_9$).

TABLE V

| Example | S (g/t) | Total yield % | c (%) in the concentrate $SnO_2$ | $SiO_2$ | $F_2O_3$ | m($SnO_2$) % |
|---|---|---|---|---|---|---|
| 4a | 450 | 23.2 | 3.6 | 40.5 | 15.1 | 75.9 |
| 4b | 300 | 19.3 | 4.0 | 37.6 | 14.9 | 70.2 |
| $V_7$ | 450 | 4.7 | 4.2 | 30.5 | 18.1 | 17.9 |
| $V_8$ | 300 | 4.2 | 4.2 | 37.9 | 10.4 | 16.0 |
| $V_9$ | 300 | 18.2 | 4.0 | 38.4 | 15.2 | 66.2 |

Once again, the use of fatty acid lactylate leads to a higher yield for the same, or only slightly reduced, content of cassiterite in the concentrate.

What is claimed is:

1. A method of separating non-sulfidic minerals from an ore in which they are contained by flotation comprising the steps of:

(a) mixing said ore in ground form with water to form an aqueous suspension thereof;

(b) adding to the aqueous suspension an effective quantity of at least one collector having the formula:

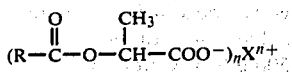

I wherein R represents an aliphatic, cyclic, or alicyclic $C_7$–$C_{23}$ radical, optionally substituted with one or more hydroxyl sulfhydryl, carbonyl, ether, or thioether groups, $X^{n+}$ is hydrogen or a water-solubilizing, salt forming cation, and n is the valence of X;

(c) introducing air into the aqueous suspension to form a froth that floats on the surface of the suspension, wherein the froth contains a concentrate of the non-sulfidic minerals; and (d) separating off the froth containing said concentrate from the aqueous suspension.

2. A method in accordance with claim 1 wherein R is a linear or branched chain alkyl or alkenyl group, wherein the alkenyl group has one or two double bonds, and wherein R can optionally be substituted with at least one hydroxyl group.

3. A method in accordance with claim 1 in which the acyl radical

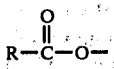

is derived from a mixture of linear fatty acids wherein at least about 25% by weight thereof are mono- and/or polyunsaturated.

4. A method in accordance with claim 1 wherein $X^{n+}$ is an alkali metal cation, a magnesium cation, an ammonium cation, or a cation of an organic ammonium base.

5. A method in accordance with claim 1 wherein in step (b) the compound of formula I is used in from about 100 to about 3000 g/t of ore.

6. A method in accordance with claim 5 wherein from about 100 to about 2000 g/t is employed.

7. A method in accordance with claim 5 wherein from about 100 to about 1000 g/t is employed.

8. A method in accordance with claim 1 wherein in step (a) or (b) at least one other collector, foaming agent, or depressor is added.

9. An aqueous suspension of a ground ore containing nonsulfidic minerals and a flotation effective quantity of a collector having the formula:

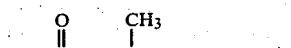

I wherein R represents an aliphatic, cyclic, or alicyclic $C_7$–$C_{23}$ radical, optionally substituted with one or more hydroxyl, sulfhydryl, carbonyl, ether, or thioether groups; $X^{n+}$ is hydrogen or a water-solubilizing, salt-forming cation; and n is the valence of X.

10. An aqueous suspension in accordance with claim 9 wherein R in the compound of formula I is a linear or branched chain alkyl or alkenyl group, wherein the alkenyl group has one or two double bonds, and wherein R can optionally be substituted with at least one hydroxyl group.

11. An aqueous suspension in accordance with claim 9 wherein the acyl radical

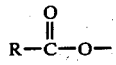

in the compound of formula I is derived from a mixture of linear fatty acids wherein at least about 25% by weight thereof are mono- and/or polyunsaturated.

12. An aqueous suspension in accordance with claim 9 wherein $X^{n+}$ in the compound of formula I is an alkali metal cation, a magnesium cation, an ammonium cation, or a cation of an organic ammonium base.

13. An aqueous suspension in accordance with claim 9 wherein the compound of formula I is present in an amount of from about 100 to about 3000 g/t of ore.

14. An aqueous suspension in accordance with claim 9 wherein the compound of formula I is present in an amount of from about 100 to about 2000 g/t of ore.

15. An aqueous suspension in accordance with claim 9 wherein the compound of formula I is present in an amount of from about 100 to about 1000 g/t or ore.

16. An aqueous suspension in accordance with claim 9 wherein at least one other collector, foaming agent or depressor is also present.

17. A non-sulfidic mineral concentrate having associated therewith at least one collector having the formula:

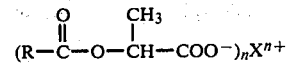

I wherein R represents an aliphatic, cyclic, or alicyclic $C_7$–$C_{23}$ radical optionally substituted with one or more hydroxyl, sulfhydryl, carbonyl, ether, or thioether groups; $X^{n+}$ is hydrogen or a water-solubilizing, salt-forming cation; and n is the valence of X.

18. A non-sulfidic mineral concentrate in accordance with claim 17 wherein R in the compound of formula I is a linear or branched chain alkyl or alkenyl group, wherein the alkenyl group has one or two double bonds, and wherein R can optionally be substituted with at least one hydroxyl group.

19. A non-sulfidic mineral concentrate in accordance with claim 17 wherein the acyl radical in the compound of formula I is derived from a mixture of linear fatty acids wherein at least about 25% by weight thereof are mono- and/or polyunsaturated.

$$R-\overset{\overset{\displaystyle O}{\|}}{C}-O-$$

20. A non-sulfidic mineral concentration in accordance with claim 17 wherein the compound of formula I $X^{n+}$ is an alkali metal cation, a magnesium cation, an ammonium cation, or a cation of an organic ammonium base.

* * * * *